US005697514A

United States Patent [19]

Hekal

[11] Patent Number: 5,697,514

[45] Date of Patent: Dec. 16, 1997

[54] CONTAINER AND CLOSURE WITH IN-TURNED SEAM

[75] Inventor: Ihab Hekal, Stamford, Conn.

[73] Assignee: Polystar Packaging, Inc., Norwalk, Conn.

[21] Appl. No.: 293,950

[22] Filed: Aug. 24, 1994

[51] Int. Cl.[6] ..... B65D 43/02

[52] U.S. Cl. ..... 220/359; 220/611; 220/613; 220/620

[58] Field of Search ..... 220/610–612, 220/615, 616, 620, 623, 618, 670, 359

[56] References Cited

U.S. PATENT DOCUMENTS

| | | | |
|---|---|---|---|
| 1,325,231 | 12/1919 | Cochrane | 220/620 X |
| 1,700,742 | 2/1929 | Moore | 229/5.6 |
| 1,866,488 | 7/1932 | Royle et al. | 229/5.6 |
| 1,886,803 | 11/1932 | Giesler | 220/615 X |
| 2,094,241 | 9/1937 | Herrmann | 229/5.5 |
| 2,146,226 | 2/1939 | Punte | 229/5.5 |
| 2,598,962 | 6/1952 | Anseele | 220/616 |
| 3,071,281 | 1/1963 | Sawai | 220/611 X |
| 3,504,817 | 4/1970 | Heider | 220/613 X |
| 4,529,100 | 7/1985 | Ingemann | 220/270 X |
| 5,125,528 | 6/1992 | Heyn et al. | 220/269 |
| 5,163,575 | 11/1992 | Luch et al. | 220/276 |
| 5,328,045 | 7/1994 | Yoshida | 220/270 X |

FOREIGN PATENT DOCUMENTS 157523 7/1954 Australia .

*Primary Examiner*—Stephen P. Garbe
*Attorney, Agent, or Firm*—William H. Holt

[57] ABSTRACT

Closing of a metal container and the like using a special end closure. The open end portion of a container is outwardly folded to define a supporting ledge and a seaming or curling flange for the end closure. Such flange is folded or rolled inwardly to capture an end closure including a plastic frame that defines a dispensing opening and has bonded thereto an end panel to be peeled back to allow dispensing of product. A seaming flange is folded about a peripheral portion of an outer boundary of the frame member and then the two are enfolded generally flat above the supporting ledge of the container to form an inwardly directed seam. A modified end closure comprises a molded plastic frame member which matches the configuration of a ledge portion of the container so the seaming flange and peripheral border portion of the frame member can be rolled together in an inwardly directed curl. The closing operations can be performed without axial pressure on the container wall so they can be thinner than normal.

Inwardly directed seams and curls protect the plastic end closure from damage caused by closing tools because dies and/or chucks contact the flange portion of the container rather than the end closure. A seal between the inwardly turned seam or curl and the border portion of the frame member can be enhanced by applying heat during formation thereof or during retorting of the container and product.

3 Claims, 4 Drawing Sheets

CONTAINER AND CLOSURE WITH IN-TURNED SEAM

This invention relates in general to new and useful improvements in end closures for containers, and more particularly to an end closure that includes an annular frame member which carries a peelable end panel.

BACKGROUND OF THE INVENTION

It is well known to double seam metal end closures onto metal or plastic containers utilizing a conventional double seaming operation. Such a double seam is turned radially outwardly so that the material of the end closure encapsulates the peripheral end portion of the container.

SUMMARY OF THE INVENTION

In accordance with the present invention, a reverse seaming approach is made wherein the open end of a container is provided with a support flange which is radially outwardly directed and which, in turn, carries an axially extending seaming flange. This permits an end closure having a frame member carrying a peelable end panel to be seated on the support flange with a peripheral border portion that is secured to the container by way of a seam between the container seaming flange and the peripheral border portion or flange on the end closure.

The radially inwardly directed seam may either be in the form of a single or double seam folded flat in overlying relation to the support flange or in the form of a molded frame member having an undersurface which conforms to the contour of a closing flange portion of the container. While the frame member is preferably formed of molded plastic material, in at least one embodiment of the invention the frame member may be formed of metal, or paper, or plastic coated paper, which may be die cut or stamped.

Thus, in essence, the present invention teaches a reverse approach from the prior art in that a reverse seaming, or reverse double seaming, or a reverse curling is used to affix an end closure, either plastic or a composite plastic and metal end closure, to a metal can or container. If a seaming flange on a metal can is heavy enough, it is feasible to reverse seam, or reverse double seam, a plastic lid to a metal can; on the other hand, if the flange on the can, or on a container such as a tray, is relatively thin, a reverse or inwardly formed curl would likely be more appropriate.

Further, after inwardly curling or seaming, the plastic of the frame portion of the end closure could be heated and fused to the metal in the curl without axial pressure on the container because the curl would hold the end closure in place on the container during heating and cooling of the curl and the encapsulated plastic. This feature provides for the use of containers having thinner walls than formerly possible, as well as providing a seal having enhanced integrity.

The end closure is preferably formed of two parts, or components, one being an annular frame portion being formed of strong or heavy material such as molded, stamped or die cut sheets of plastic, metal or coated paper which is intended to be permanently affixed to the can or container, and the other part being a peelable member which is to be peeled away from the frame portion for opening the can and gaining access to the contents of the container. The peelable member, or end panel, may be made of various materials such as plastic sheet, paper or metal foil, which may be coated or uncoated, or a laminate such as a plastic coated aluminum laminate, in the form of a peelable layer to be attached to the frame portion through the use of heat, or adhesives, or suitable solvents, or during an injection molding operation for forming the frame portion and adhering it to the removable end panel. End closures having peelable end panels of a suitable type and construction are shown and described in U.S. Pat. Nos. 5,085,339 and 5,125,528 belonging to Polystar Packaging, Incorporated of Norwalk, Conn., U.S.A.

DETAILED DESCRIPTION

Figure 1:
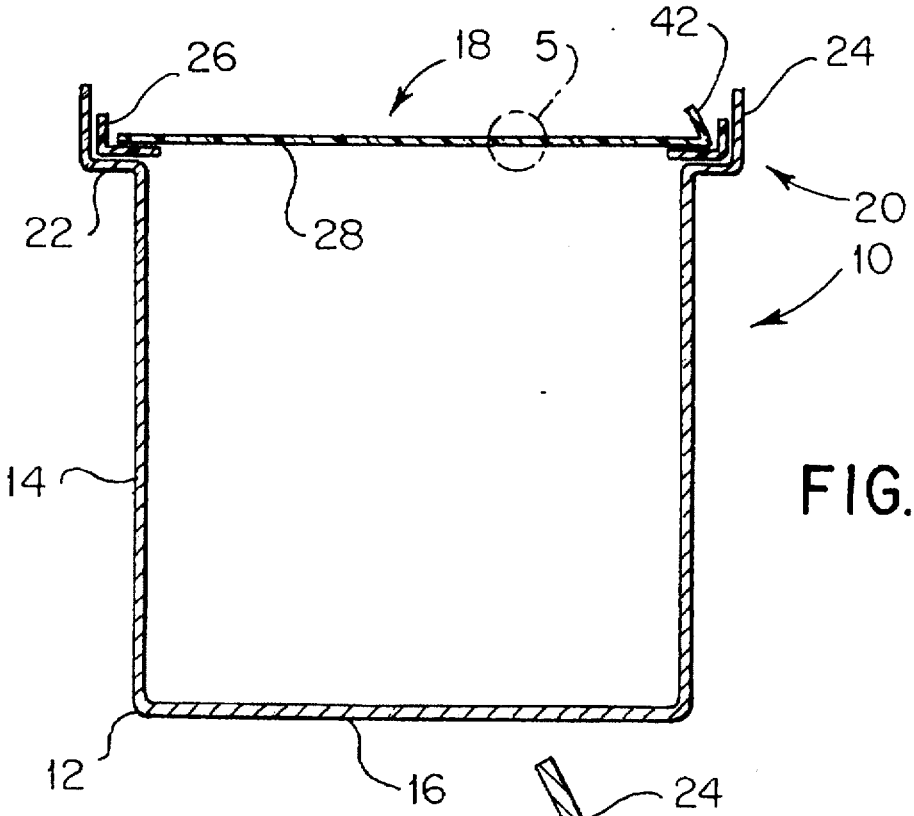
FIG. 1 is a vertical sectional view through a container having positioned in place an end closure for sealing in accordance with the invention, the various components being illustrated in spaced relation so as to distinguish the components.

Referring now to the drawings in detail, reference is first made to the embodiment illustrated in FIGS. 1 through 4 wherein there is shown a container 10, generally in the form of a can 12 having an upstanding body 14 and a bottom 16. The can 12 has an open upper end first receiving a product to be packaged and for closing by an end closure generally identified by the numeral 18. The open end of the can 12 is generally identified by the numeral 20 and includes a peripheral inner ledge portion or support flange 22 which, in turn, carries an outer axially directed flange or seaming flange 24.

Figure 2:
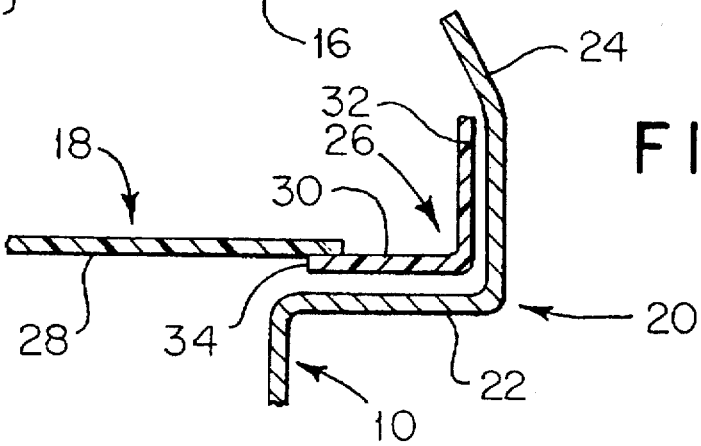
FIG. 2 is a fragmentary sectional view on a larger scale showing most specifically the configuration of the end closure and the container with the end closure in position within an open end of the container and a seaming flange of the container being partially folded.

As is best illustrated in FIG. 2, the end closure 18 includes a frame member generally identified by the numeral 26 which carries a peelable panel 28. The frame member 26 includes a continuous peripheral inner ledge portion 30 and an outer upstanding peripheral border portion 32. The inner peripheral edge of ledge portion 30 defines an opening 34 through which a product packaged within the container 10 may be readily dispensed. This opening is normally closed by the panel 28 which has a peelable bond with the ledge portion 30.

Figure 5:
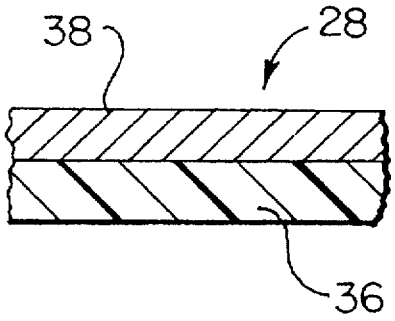
FIG. 5 is a fragmentary sectional view identified in FIG. 1 and shows a typical end panel construction having plural layers.

At this time it is pointed out that, as is best illustrated in FIG. 5, the panel 28 is preferably of a laminated construction including an inner plastic layer 36 and an outer metal foil layer 38 which are suitably bonded together.

Also, it is to be understood that the frame member 26 may be formed of a plastic material, such as by injection molding, and the panel 28 peelably bonded thereto by an insert-injection molding operation. However, the invention is not to be so limited. It is feasible that the panel 28 be of a single layer construction and may be formed of either plastic or metal foil and will be suitably bonded to the frame member 26 by injection molding of the frame member 26 or by way of a suitable peelable adhesive (not shown).

It is also feasible that the frame member be stamped of sheet metal and the panel 28 peelably bonded thereto in any conventional known way.

While the container 10 has been specifically illustrated, it is to be understood that in accordance with the present practice, the wall thickness of the can, and most particularly of the seaming flange 24 will be 6 mils or greater. On the other hand, the container 10 could be in the form of a basket (not shown) formed of a metal foil or the like and having a thickness less than 6 mils.

Figure 3:
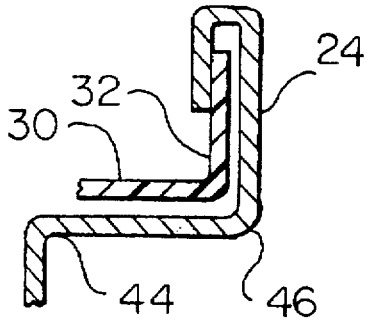
FIG. 3 is a sectional view similar to FIG. 2, but shows the container seaming flange being folded around an outer and upper end of the end closure peripheral border portion as a first step in the seaming operation.
Figure 4:
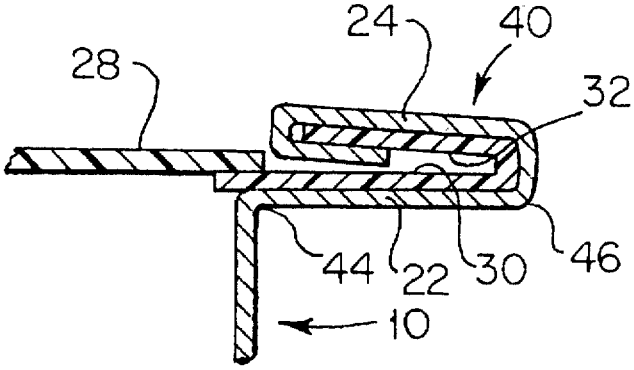
FIG. 4 is another sectional view, similar to FIG. 2, showing the completion of the seaming operation wherein the peripheral border portion and the container seaming flange are further folded into overlying relation to the frame member peripheral inner ledge portion.

As will be apparent from FIGS. 2–4, it is necessary that the seaming flange 24 be of a thickness and flexibility so as to permit the folding thereof by itself, as shown in FIGS. 2 and 3, and thereafter with the border portion 32 as shown in FIG. 4. The resulting seam, which is generally identified by the numeral 40 includes two seaming steps and thus may be broadly identified as "a double seam". However, the seam 40 is not a conventional double seam in that the seaming or folding steps are radially inwardly directed into the interior of the seaming flange 24. On the other hand, the seam 40 may be automatically formed by a series of chucks and cams (not shown) in the same general manner as a conventional double seam. As is best shown in FIG. 4, an elongated seal is created between the underside of ledge portion 30 and support flange 22 and extending from an inner bend 44 and an outer bend 46 thereof. Likewise, an elongated seal is created between the border portion 32 and seaming flange 24.

It is to be understood that the peelable panel 28 will preferably be provided with a suitable pull tab 42, as shown in FIG. 1, so as to facilitate the peeling of the panel 28 from the frame member 26.

It will also be understood that the opened container 10 closed with the end closure 18 will be void of any raw edge on which a user may cut oneself.

Figure 6:
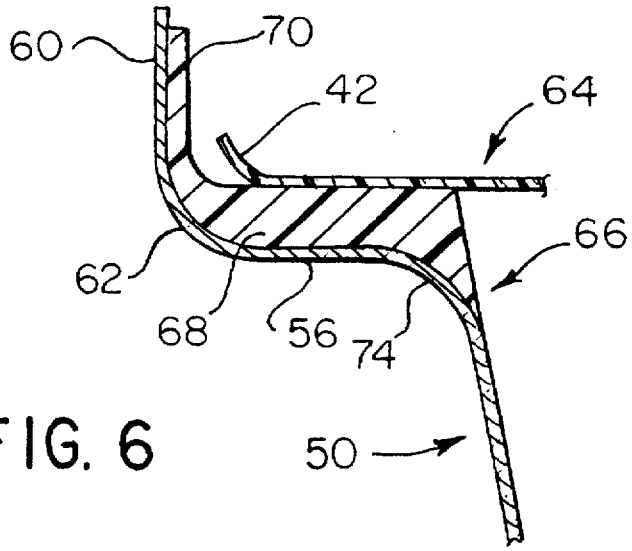
FIG. 6 is a vertical sectional view taken through a modified container configuration and a modified form of end closure with the end closure seated on the supporting flange of the container in position ready for a curling operation to secure the end closure to the container.
Figure 7:
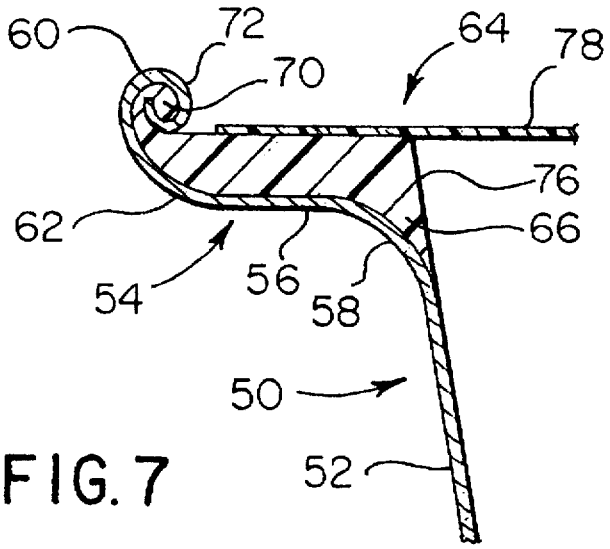
FIG. 7 is sectional view similar to FIG. 6 and shows the end closure secured to the container by a radially inwardly directed curl.

A second embodiment of the invention is illustrated in FIGS. 6 and 7 wherein a container, generally identified by the numeral 50, and including an upper side wall portion 52 which has a formed top potion, generally indicated by the numeral 54. Top portion 54 includes a support flange 56 extending between an inner curve or bend 58 and an outer curve or bend 62 and terminates at its outer periphery forming a seaming flange 60.

Wall portion 52, of container 50, is shown as extending upwardly and outwardly. It is to be understood, however, that the wall portion may extend axially in the same manner as body 14 of can 12, as is shown in FIG. 1. Also, container 50 can be of other shapes and may be in the form known in the art as a tray.

Container 50 is to be closed and sealed with an end closure, generally indicated by the numeral 64. It will be seen that the end closure 64 includes a frame member 66 having a continuous peripheral inner ledge portion 68 and an outer upstanding peripheral border portion 70. Further, as is best shown in FIG. 7, the border portion 70 is seamed relative to the seaming flange 60 by way of a curled-type seam 72. Heat is to be applied to curl 72 in those instances in which great assurance of a complete seal is necessary or desired; the process step of applying heat may occur during the seaming or curling operation, or subsequent thereto, such as during a retorting operation for processing the contents of the sealed container.

At this time it is to be understood that such a seam 72 could have been incorporated in conjunction with the container 10 and the closure 18. However, in the embodiment shown in FIGS. 6 and 7, in lieu of the frame member 66 being of a generally constant wall thickness as in the case of the frame member 26, the frame member 66 is definitely of a molded construction and the peripheral ledge portion 68 has an undersurface 74 of a contour matching the upper or outer surface of the support flange 56 including the portions of the curves 58 and 62. This provides not only a good seat of the frame member 66 onto the container 50 during initial assembly, but also an elongated secondary seal in addition to the seal formed by the curled seam 72.

Further, it is to be noted that the peripheral inner ledge portion 68 has an inner edge surface 76 which may form a continuation of the inner surface of the body 52 so as to facilitate dispensing of the product from the container 50.

The end closure 64 further includes an end panel 78 which is peelably sealed to the upper surface of the peripheral inner ledge portion 68 in the manner described with respect to peelable panel 28. The panel 78 may be either a laminated construction as shown in FIG. 5 or a single thickness panel construction, such as in the earlier described panel 28.

Figure 8:
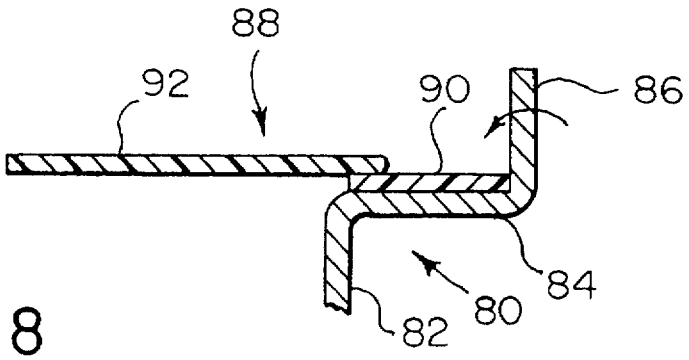
FIG. 8 is a fragmentary sectional view of another embodiment of the invention and shows an end closure resting upon the support flange of a container preparatory to closing of the container.
Figure 9:
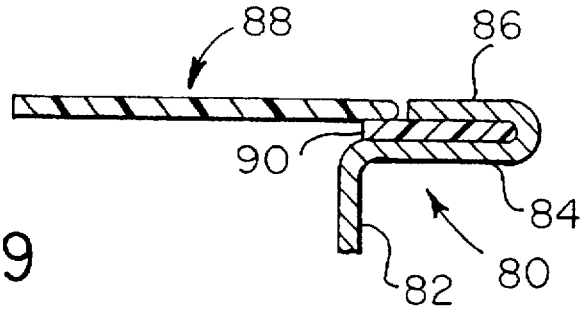
FIG. 9 is a sectional view similar to FIG. 8 and shows the end closure secured to the container by a radially inwardly folded seaming flange.

Referring to FIGS. 8 and 9, a further embodiment of the invention is illustrated as being comprised of a container, generally indicated by the numeral 80, includes a wall portion 82, an outwardly extending support flange 84 and a seaming flange 86. An end closure, generally indicated by the numeral 88, includes an annular frame member 90 and a peelable end panel overlying the frame member 90 axially outwardly thereof and in sealed, but peelable, relation thereto.

As is shown in FIG. 9, seaming flange 86 is folded radially inwardly for securing frame member 90 is sealing relation between seaming flange 86 and support flange 84 for closing container 80. It is to be understood that end panel 88 is preferably provided with a pull tab, such as pull tab 42 shown in FIG. 4, for opening container 80 by peeling end panel 88 upwardly and outwardly from frame member 90. In a preferred form of the embodiment of FIGS. 8 and 9, the container 80, including the support flange 84 and the seaming flange 86, are formed of metal. Either during the seaming operation, or in a separate step thereafter, heat can be applied through the metal of flanges 84 and 86 to the seam for providing a fused interface with the plastic of frame member 90 for creating an hermetic seal.

Figure 10:
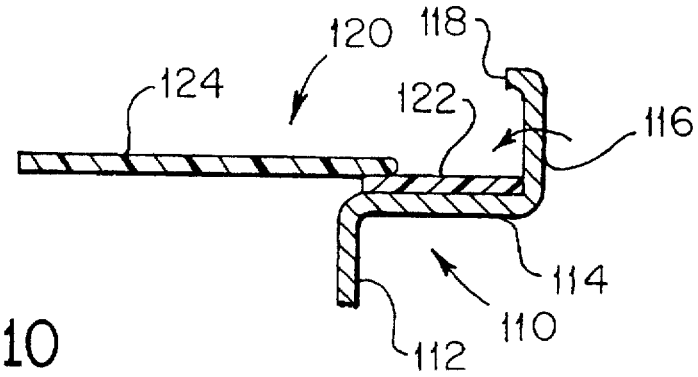
FIG. 10 is a fragmentary sectional view of a further embodiment of the invention and shows an end closure resting upon the support flange of a container preparatory to closing of the container wherein a seaming flange of the container includes a sharply turned raw edge portion.
Figure 11:
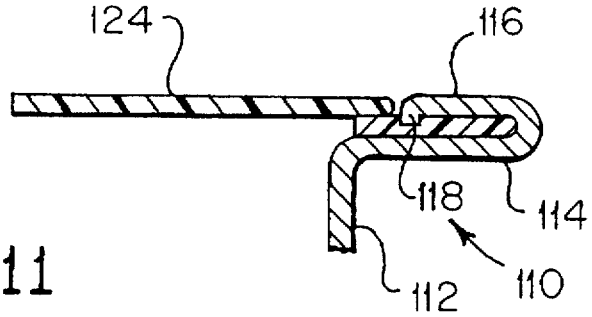
FIG. 11 is a sectional view similar to FIG. 10 and shows the end closure secured to the container such that the raw edge portion of the seaming flange is embedded into the material of the end closure for protecting the raw edge against rust and/or for producing a smooth closure free of sharp edges.

A further embodiment of the invention is illustrated in FIGS. 10 and 11 wherein a container, generally indicated by the numeral 110, includes a tubular wall portion 112, an outwardly extending support flange 114 and a seaming flange 116 having a sharply inwardly turned raw edge portion 118. An end closure, generally indicated by the numeral 120, includes an annular frame member 122 and a peelable end panel 124 overlying the frame member 122 axially outwardly thereof and in sealed, but peelable relation thereto. Seaming flange 116 is folded or bent inwardly and downwardly, as is indicated by the curved arrow in FIG. 10, to grip the annular frame member 122 of the end closure 120. As is best shown in FIG. 11, edge portion 118 is embedded in the material of frame member 122 thereby protecting the edge portion against rust and/or providing a smooth seam for connecting the end closure 120 to the container 110. It is to be understood that, similar to the embodiment of FIGS. 8 and 9, heat may be applied to the seam during or after forming thereof. The seaming tools (not shown) may be hot during the seaming operation or, metal containers may be heated using radio frequency heating or induction heating to soften the plastic material of the frame member 122 to allow burying of the edge portion 118, as best shown in FIG. 11, and also create a fused interface between frame member 122, support flange 114 and seaming flange 116 for enhancing the integrity of the seam.

Figure 12:
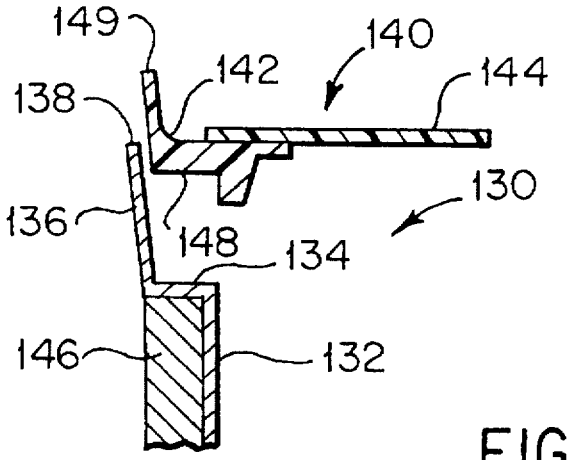
FIG. 12 is a fragmentary sectional view of an end closure and container with the end closure being assembled during a closing operation wherein the container includes an upstanding seaming flange inclined, or tapered, slightly outwardly.
Figure 13:
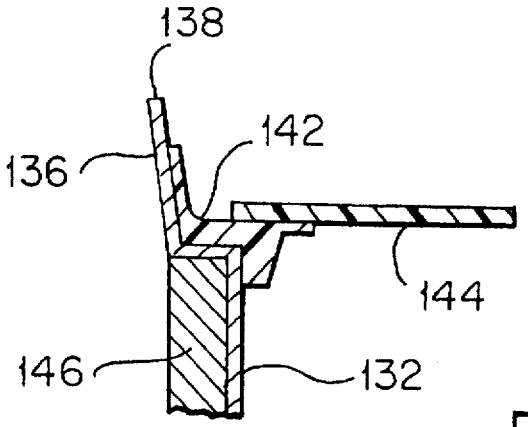
FIG. 13 is a fragmentary sectional view similar to FIG. 12 and shows the end closure seated upon a support flange of the container which is resting upon an anvil portion of a closing tool.
Figure 14:
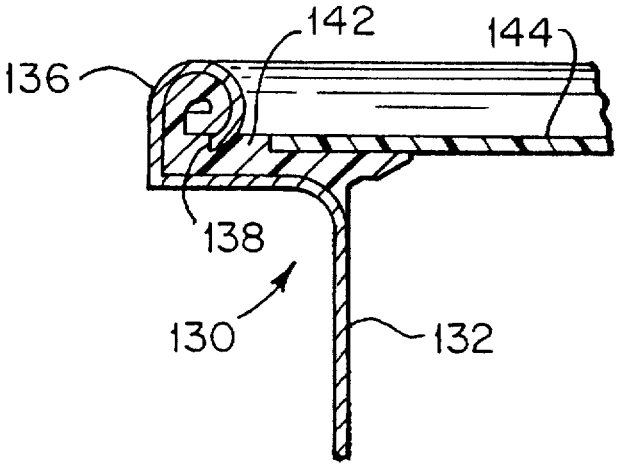
FIG. 14 is a fragmentary sectional view similar to FIGS. 12 and 13 and shows a seaming flange of the container and a peripheral border portion of the end closure folded inwardly for closing the container and producing a seam wherein the free edge of the container is buried in the material of the end closure.

A still further embodiment of the invention is shown in FIGS. 12, 13 and 14 wherein a container, generally indicated by the numeral 130, includes a tubular side wall 132, an outwardly extending support flange 134, and a seaming flange 136 which is shown extending outwardly and upwardly terminating at an edge portion 138, for providing a tapered lead-in of approximately 5 or 6 degrees for receiving an end closure, generally indicated by the numeral 140, and including an annular frame member 142 having an end panel 144 peelably secured to a top portion thereof. Container 130 is shown resting upon an anvil portion 146 of a closing tool. Frame member 142 has a lower surface 148 and an upstanding seaming portion 149 shaped to conform with corresponding portions of container 130, in the manner best shown in FIG. 13, incident to the seaming process wherein seaming flange 136 is folded or bent radially inwardly and downwardly for interlocking end closure 140 with container 130 and container edge portion 138 is buried within the material of end closure 140. In the same manner as previously described, it is to be understood that heat may be used to create a fused interface for enhancing the integrity of the final seam.

Although several preferred embodiments of the invention have been specifically illustrated and described herein, it is to be understood that minor variations made be made in the end closure constructions and the manner in which it is sealed relative to a container without departing from the spirit and scope of the invention as defined in the appended claims.

I claim:

1. An end closure for closing an open end of a container, said end closure comprising a frame member and an end panel, said frame member having a continuous peripheral inner ledge portion and a peripheral outer border portion terminating in a free edge, said inner ledge portion defining an opening in said frame member for providing a passage for a packaged product therethrough, said end panel having a marginal outer edge portion secured to said inner ledge portion for closing said opening, said outer border portion being turned generally axially upwardly and inwardly and forming part of attachment means for securing said end closure to a container body, in combination with a container having an open end defined in part by an outwardly directed seaming flange, said end closure being received by said seaming flange, and said seaming flange and said peripheral outer border portion being folded radially inwardly together for forming a seam securing said end closure to said container in sealed relation, wherein said seam is in the form of a curl seated on said peripheral inner ledge portion radially outwardly of said end panel.

2. An end closure for closing an open end of a container, said end closure comprising a frame member and an end panel, said frame member having a continuous peripheral inner ledge portion and a peripheral outer border portion terminating in a free edge, said inner ledge portion defining an opening in said frame member for providing a passage for a packaged product therethrough, said end panel having a marginal outer edge portion secured to said inner ledge portion for closing said opening, said outer border portion being turned generally axially upwardly and inwardly and forming part of attachment means for securing said end closure to a container body, in combination with a container having an open end defined in part by an outwardly directed seaming flange, said end closure being received by said seaming flange, and said seaming flange and said peripheral outer border portion being folded radially inwardly together for forming a seam securing said end closure to said container in sealed relation, wherein said frame member is formed of plastic and said seaming flange is formed of metal, said frame member and said seaming flange being adhered together, and wherein said seaming flange includes a raw edge, and said raw edge is buried in said frame member.

3. An end closure for closing an open end of a container, said end closure comprising a frame member and an end panel, said frame member having a continuous peripheral inner ledge portion and a peripheral outer border portion terminating in a free edge, said inner ledge portion defining an opening in said frame member for providing a passage for a packaged product therethrough, said end panel having a marginal outer edge portion secured to said inner ledge portion for closing said opening, said outer border portion being turned generally axially upwardly and inwardly and forming part of attachment means for securing said end closure to a container body, in combination with a container having an open end defined in part by an outwardly directed seaming flange, said end closure being received by said seaming flange, said seaming flange and said peripheral outer border portion being folded radially inwardly together for forming a seam securing said end closure to said container in sealed relation, and wherein said seaming flange includes a raw edge, and said raw edge is buried in said frame member.

* * * * *